US005128175A

United States Patent [19]

Yamanishi et al.

[11] Patent Number: 5,128,175

[45] Date of Patent: Jul. 7, 1992

[54] INSULATED ELECTRIC WIRE AND PROCESS FOR PRODUCING THE SAME

[75] Inventors: Toru Yamanishi; Tatsuya Kakuta, both of Kanagawa; Akinori Mori, Tochigi, all of Japan

[73] Assignee: Sumitomo Electric Industries, Ltd., Osaka, Japan

[21] Appl. No.: 492,794

[22] Filed: Mar. 13, 1990

[30] Foreign Application Priority Data

| | | | |
|---|---|---|---|
| Mar. 15, 1989 | [JP] | Japan | 1-60881 |
| Apr. 17, 1989 | [JP] | Japan | 1-95371 |
| May 1, 1989 | [JP] | Japan | 1-109141 |
| Aug. 4, 1989 | [JP] | Japan | 1-201405 |

[51] Int. Cl.[5] ..... B05D 3/06; B05D 5/12; B28B 1/50

[52] U.S. Cl. ..... 427/54.1; 427/119; 427/120; 427/247; 427/318; 425/4 R; 425/174.4; 264/22; 264/46.6; 264/45.8

[58] Field of Search ..... 427/54.1, 247, 120, 427/53.1, 55, 44, 245, 119, 373, 388.1, 314, 318; 425/4 R, 174.4; 264/22, 45.4, 45.8, 45.9, 46.6, 46.7

[56] References Cited

U.S. PATENT DOCUMENTS

| | | | |
|---|---|---|---|
| 4,273,806 | 6/1981 | Stechler | 427/120 |
| 4,481,258 | 11/1954 | Sattler et al. | 427/120 |
| 4,518,648 | 5/1985 | Miyata et al. | 427/58 |
| 4,539,167 | 9/1985 | Schedel | 425/4 R |
| 4,829,094 | 5/1989 | Melber et al. | 427/222 |

FOREIGN PATENT DOCUMENTS 0102899 3/1984 European Pat. Off. .

*Primary Examiner*—Marianne Padgett
*Attorney, Agent, or Firm*—Cushman, Darby & Cushman

[57] ABSTRACT

A process for producing an insulated electric wire, comprising the steps of coating around a conductor an energy radiation curable resin composition having heat expansible microspheres incorporated therein, and curing the energy radiation curable resin composition thus coated on the conductor by exposure to an energy radiation. The process also comprises the step of heating the energy radiation curable resin composition to expand the heat expansible microspheres in the energy radiaiton curable resin composition, thereby forming a high-porosity insulation layer on the conductor. An insulated electric wire comprises a conductor; an energy radiation curable resin composition layer having microspheres incorporated therein and surrounding the conductor, the outside diameter of the microspheres in the energy radiation curable resin composition layer being maximum in the vicinity of the conductor and decreasing gradually toward the periphery of the energy radiation curable resin composition layer.

2 Claims, 5 Drawing Sheets

INSULATED ELECTRIC WIRE AND PROCESS FOR PRODUCING THE SAME

BACKGROUND OF THE INVENTION

1. Field of Invention

This invention relates to a fine insulated electric wire having low dielectric constant, and a process for producing the same.

2. Prior Art

Thin insulation layers are conventionally formed on a conductor by a foaming extrusion method as described in JP-B-57-30253 (the term "JP-B" as used herein means as "examined Japanese patent publication"). This technique generally comprises foaming polyolefinic resins with a chemical foaming agent (e.g. azodicarbonamide), an inert gas (e.g. nitrogen or argon) or a gaseous or liquid hydrocarbon or fluorocarbon, which are used either alone or as admixtures, to thereby form an insulation coating layer having low dielectric constant due to enhanced porosity.

U.S. Pat. Nos. 3,953,566 and 4,187,390 describe another method of forming an insulation layers, in which a fluorine resin tape provided with enhanced porosity by stretching is wound over a conductor. Compared to the foaming extrusion technique, this method which involves winding a tape material having a known dielectric constant over the conductor is capable of not only insuring consistency in the dielectric constant of an insulation layer but also producing a thin and high-porosity insulation layer.

Two other methods of forming insulated electric wires are proposed in JP-B-56-43564 and JP-B-57-39006. The first patent discloses a method in which microspheres or foamable spheres that have a particle size of from several microns to several millimeters and that are made of an inorganic material such as glass or alumina are coated with a thermoplastic resin and then melt-extruded The second patent discloses a method in which a thermoplastic resin such as polyethylene or polyvinyl chloride and inorganic microspheres are dissolved in a solvent such as xylene and the solution is applied onto a conductor, with the resulting coating being dried to form an insulated electric wire.

An increasing demand for fine transmission lines capable of carrying high-density signal has arisen in the medical field, computerized measurement field and various other fields, and there is a strong need for the development of fine insulated electric wires that have a thin insulation coating applied to a fine conductor and that yet have low dielectric constant.

None of the prior art methods described above are suitable for meeting this need. In the method described in JP-B-57-30253, melting of a polyolefinic resin, its foaming and coating onto a conductor are performed simultaneously by means of a screw extruder, so it is difficult to attain a high degree of foaming in thin insulation layers and the lower limit of the coating thickness that can be achieved is no smaller than 200 μm. Another defect of this method is that it is not easy to control the degree of foaming.

The methods described in U.S. Pat. Nos. 3,953,566 and 4,187,390 have the inherent problem that the formation of local asperities in the surface of insulation layer is unavoidable and the linear speed of wire production is very low.

The methods described in Jp-B-56-43564 and JP-B-57-39006 are capable of controlling the degree of foaming in an easy way but they have the following defects. In the method described in JP- -56-43564 which extrusion-coats a conductor with hollow or foamable spheres having a thermoplastic resin coated thereon, the thermoplastic resin on the microspheres melts to be applied onto the conductor and is thereafter cooled to join the microspheres together. Therefore, if the thickness of the thermoplastic resin layer is reduced in order to attain high porosity, the mechanical strength, in particular, the elongation, of the insulation layer formed on the conductor will deteriorate considerably. If, on the other hand, the thickness of the thermoplastic resin layer on the surface of microspheres is increased in order to retain the mechanical strength of the insulation layer, the porosity of the insulation layer will decrease eventually to increase the dielectric constant of the electric wire. Further, in order to withstand the high temperature (≧150° C.) and pressure that develop in the extruder for a long time, the microspheres that can be used are limited to those which are made of inorganic materials such as glass and alumina. However, such microspheres intrinsically have high dielectric constant and are not suitable for the purpose of producing low-dielectric constant, low-loss cables.

The method described in JP-B-57-39006 comprises dissolving inorganic microspheres and a thermoplastic resin such as polyethylene or polyvinyl chloride in a solvent such as xylene, applying the solution onto a conductor and drying the resulting coating to form an insulated electric wire. This approach also applies heat for drying purposes in the same manner as that in JP-B-56-43564. In this case, heating temperature is relatively lower and a time required for heating process is also shorter than those in JP-B-56-43564. However, the heating time is not a moment which is shorter than 1 to 2 seconds. As a result, the microspheres that can be used are limited, which introduces difficulty in producing low-dielectric constant, low-loss cables. Further, the need for uniformly drying the applied liquid composition by evaporating the solvent renders the production speed very low.

SUMMARY OF THE INVENTION

An object of the present invention is to eliminate the aforementioned drawbacks of the prior art and to provide a process for producing an insulated electric wire that has satisfactory electric characteristics, that has low dielectric constant and that can be coated with a thin layer (≦200 μm).

As a result of continued research efforts to attain this object, the present inventors found that a small-diameter and low-capacitance insulated electric wire that could not be realized by the prior art can be produced by an entirely new method. The present invention has been accomplished on the basis of this finding.

The present invention provides a process for producing an insulated electric wire having a foamed insulation layer formed around a conductor, which process is characterized in that an energy radiation curable resin composition having heat expansible microspheres incorporated therein is coated around the conductor and subsequently heated to form a high-porosity resin coating layer. The insulated electric wire thus produced has low capacitance even if it has a thin insulation layer. Further, the coating layer is uniform and high-speed wire production is possible.

Also, the present invention provides an insulated electric wire having an inner and an outer insulation layer formed around a conductor, which wire is characterized in that said inner insulation layer is formed of an energy radiation curable resin composition having heat expansible microspheres confined therein and has a thick-walled portion through a cross section in the longitudinal direction and/or circumferential direction of said conductor, with a cylindrical outer insulation layer being formed in contact with said thick-walled portion. This wire has a thin outer insulation coating and yet it is low in capacitance. Further, it can be produced at high speed with the outer coating layer kept smooth without experiencing undue variations in capacitance even in the presence of disturbances from the manufacturing process.

The outer insulation layer described above may be replaced by outer conductors in a cylindrical form to construct a coaxial insulated electric wire.

If desired, the outer insulation layer may be surrounded by an outer conductor layer coaxial with the central conductor to thereby construct a coaxial insulated electric wire.

In a particularly preferred embodiment of the present invention, the inner insulation layer described above has a helical thick-walled portion.

Further, the present invention provides a process for producing an insulated electric wire which comprises applying a resin composition over a conductor, curing the applied resin composition to form an inner insulation layer and then forming an outer insulation layer, which process is characterized in that an energy radiation curable resin composition having heat expansible microspheres incorporated therein is applied over the conductor and cured by exposure to an energy radiation, and either after or simultaneously with the curing, said energy radiation curable resin composition is heated to form an inner insulation layer having a thick-walled portion through a cross section in the longitudinal direction and/or circumferential direction of said conductor, and subsequently a cylindrical outer insulation layer is formed in contact with said thick-walled portion.

A coaxial insulated electric wire can also be produced in the present invention by forming outer conductors in a cylindrical form in contact with the thick-walled portion of the inner insulation layer which is formed through a cross section in the longitudinal direction and/or circumferential direction of the central conductor as described above.

Further, the present invention provides a process for producing an insulated electric wire, which process comprises applying over a conductor an energy radiation curable resin composition having heat expansible microspheres incorporated therein, to thereby form a coated layer, then heating said coated layer, and subsequently forming an insulation coating layer by curing the energy radiation curable resin with an energy radiation being applied and with the outside diameter of the coated layer on said conductor being controlled by means of a molding unit installed in an area including the space where said coated layer is foaming and/or expanding in the radial direction.

Further, the present invention provides an apparatus for producing an insulated electric wire that comprises a quartz sizing jig and an energy radiation applying means provided around said quartz sizing jig and which is capable of curing the coated layer of energy radiation curable composition on the conductor simultaneously with its shaping.

An ultraviolet curable resin is particularly preferred for use as the energy radiation curable resin in the present invention.

If desired, the outside diameter of the coated layer is controlled with a lube oil being supplied onto the inner surface of the molding unit and this is also a particularly preferred embodiment of the present invention.

Further, the present invention provides an insulated electric wire comprising a conductor surrounded by a coating layer of an energy radiation curable resin composition having microspheres incorporated therein, which wire is characterized in that the outside diameter of the microspheres in said coating layer is maximum in the vicinity of the conductor an decreases gradually toward the periphery of the coating layer. This wire has a thin insulation coating and yet it is low in capacitance. Further, it can be produced at high speed with the coating layer kept smooth without experiencing undue variations in capacitance even in the presence of disturbances from the manufacturing process.

Further, the present invention provides a process for producing an insulated electric wire which comprises coating the periphery of a conductor with an energy radiation curable resin composition having microspheres incorporated therein, and subsequently curing said resin composition to form an insulation coating layer, which process is characterized in that heat expansible microspheres are used as said microspheres and that the energy radiation curable resin composition is applied over said conductor after it is preliminarily heated to insure that the outside diameter of the microspheres in the coating layer is maximum in the vicinity of the conductor and decreases gradually toward the periphery of the coating layer.

BRIEF DESCRIPTION OF THE DRAWINGS

FIG. 6(*b*) is a partial enlarged cross section of the inner insulation layer;

DETAILED DESCRIPTION OF THE PREFERRED EMBODIMENTS

The reason why the present invention provides a small-diameter and low-capacitance insulated electric wire that could not be realized by the prior art is described below.

Before explaining the operational aspect of the present invention, the relationship between porosity and dielectric constant need be first discussed. Porosity as considered in the present invention is measured by the density method and is calculated by the following formula (1):

$$(\rho o - \rho)/\rho o \times 100\ (\%) \qquad (1)$$

where $\rho o$ is the density of the base resin and $\rho$ is the density of a resin having pores.

As is already known, the dielectric constant, $\epsilon$, of a resin composition having pores is determined by the dielectric constant, $\epsilon_1$, of the base resin itself, the dielectric constant, $\epsilon_2$, of the gas in the pores, and the porosity, V, of the resin having the pores, and is expressed by the following formula (2):

$$\epsilon = \epsilon_1 \frac{2\epsilon_1 + \epsilon_2 - 2V(\epsilon_1 - \epsilon_2)}{2\epsilon_1 + \epsilon_2 + V(\epsilon_1 - \epsilon_2)} \qquad (2)$$

In the present invention, desired pores can be formed consistently in the coating layer by properly selecting the material in which the pores are to be formed, its porosity, the content of heat expansible microspheres in the resin composition and its constituent material, and this insures the formation of an insulation layer having a desired dielectric constant.

In the formula (2), the base resin used in the present invention consists of the composition of the resin cured by the application of energy radiation and the shell material of the expanded microspheres, and as described below, since the volume ratio of the shell material to the whole coating layer is low, the dielectric constant of the base resin is close to or the substantial same as that of the energy radiation curable resin.

Accordingly, in order to provide a coating layer having a low dielectric constant so that the object of the present invention can be achieved, that is, to make the dielectric constant no more than 1.6, if fluorocarbon materials (dielectric constant of 2 to 2.1), which have been known at present as materials having the lowest dielectric constant, is selected as an energy radiation curable resin to be used, the porosity is allowed to be adjusted to a value of no less than about 40%. However, as most of the energy radiation curable resins have the dielectric constant of no less than 3, about 3, the porosity of no less than 70% is required to make $\epsilon$ no less than 1.6 on the basis of the formula (2). Further, in order to provide a region having the low dielectric constant of no more than 1.4, the porosity of no less than 75% is required which exceeds the highest-density filling-up ratio 74% of a single microsphere.

Figure 14A:
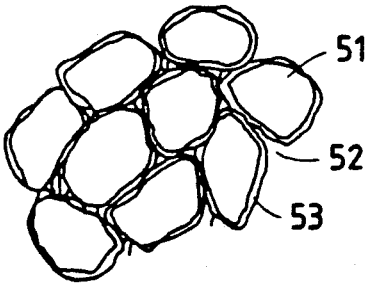
FIGS. 14(*a*) and 14(*b*) are cross sectional views showing a honeycomb structure and a sphere partly bonding structure according to the present invention, respectively.
Figure 14B:
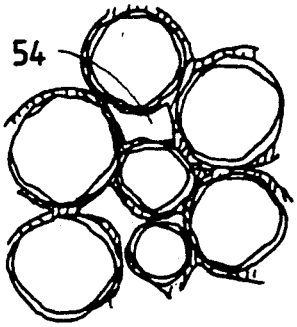

In the present invention, the coating layer of a resin composition consisting of heat expansible microspheres and an energy radiation curable resin can provide not only a porosity of 70%, but also an ultimate porosity of 90–95%, according to heating and curing means. The coating layer having enhanced porosities according to the present invention is constructed by any of a honeycomb structure shown in FIG. 14(*a*), a sphere partly bonding structure shown in FIG. 14(*b*) in which voids also exist between spheres, and a mixture of the honeycomb structure and the sphere partly bonding structure. In FIGS. 14(*a*) and 14(*b*), numeral reference 51 indicates a pore; 52, an energy radiation curable resin; 53, a shell; and 54, a void formed between microspheres. The present invention microscopically includes a structure in which an energy radiation curable resin is simply filled up between sphere.

Further, a surface of an insulation layer having a low dielectric constant and coating an insulated electric wire or a coaxial electric wire, and a state of the inner surface of the insulation layer near portions which contact a central conductor, in the longitudinal direction of the electric wire, and a distribution of voids in the insulation layer in the radial direction of the electric wire, can be suitably adjusted by selecting a process for producing an insulated electric wire.

A low dielectric constant coating layer having a honeycomb structure and a thick-walled portion in a cross section in the longitudinal direction and/or circumferential direction of a central conductor can be realized by simultaneously achieving curing and heating processes for a resin composition coated on the central conductor, or by achieving the heating process after the curing process. On the other hand, a sphere partly bonding structure can be realized by heating before the curing of the coating layer. In order to produce these two special structures, respectively, the amount of no less than 20 vol % of heat expansible microspheres, which have a volume expansion coefficient of no less than ten times, is preferably applied to provide a resin composition.

The structure which mixes these two typed structures can be remarkably produced by, in the process for producing the sphere partly bonding structure in which the energy radiation curable resin is heated to be expanded before the curing of the resin, setting a temperature in a heating furnace for a resin curing process to a temperature sufficient to expand the heat expansible microspheres, that is, by advancing the expansion of the microspheres even after the start of curing the resin by heating before the resin had been cured.

In addition, to increase the smoothing property and the function of an insulated electric wire, the coated resin composition is heated, and subsequently the energy radiation curable resin is cured with the diameter being controlled by a molding device which is arranged on an area including a space where the coating layer on the central conductor is foaming and/or being expanded in the radial direction of the central conductor so that a complete honeycomb structure can be realized. Also, a central conductor is preliminarily heated so that the outer diameter of the resin which is being coated on the central conductor is maximum near the central conductor, and is gradually reduced toward the periphery thereof.

A coating resin composition used as the material for forming a foamed insulation layer in the present invention is either an energy radiation curable resin or an energy radiation curable resin composition having heat expansible microspheres incorporated therein.

The heat expansible microspheres for use in the present invention are those spheres which have confined therein at least one member selected from among low-boiling point liquids, chemical foaming agents that release gases by a reaction such as thermal decomposition, the air and other gases such as nitrogen, argon and isobutane. The shell of the heat expansible microspheres is made of a thermoplastic resin such as vinylidene chloride, polyethylene or a fluorine resin, and the choice of a suitable thermoplastic resin is made to satisfy the requirement that the microspheres are expanded by heating at 50°-200° C. From the viewpoint of intrinsic dielectric constant, polyethylene and fluorine resins are preferred. In order to provide a coating layer that is not thicker than 200 μm and that has low capacitance, it is preferred to use a mixture of heat expansible microspheres that have diameters of 1-50 μmϕ and a volume expansion coefficient of no less than 8 times before heating process, and the d/R ratio of no more than 0.1 where d is a shell thickness and R is a radial of microspheres, after being expanded. This is because of the following three advantages that can be attained: 1) the smoothness of the coating layer is not impaired; 2) the porosity of the coating layer can be enhanced by inflating the microspheres; and 3) a volume ratio of shell material defining the expanded microspheres to the whole coating layer is reduced so that the dielectric constant of the whole coating layer is prevented from greatly increasing even though the dielectric constant of the shell material is high.

Examples of the energy radiation curable resin an resin composition that can be used in the present invention include heat-curable resins, ultraviolet curable resins, electron curable resins and resin compositions containing these resins. From the viewpoint of rapid formation of coating, ultraviolet curable resins capable of fast curing or resin compositions containing them are preferred. Examples of such energy radiation curable resins include silicone resins, epoxy resins, urethane resins, polyester resins, epoxy acrylate, urethane acrylate, fluorinated acrylate, silicone acrylate, polyester acrylate, etc. In order to reduce the capacitance of coating, the dielectric constant of the energy radiation curable resin composition itself is preferably low and the energy radiation curable resin preferably has a dielectric constant of 4.0 or below, desirably 3.0 or below. In order to further reduce the dielectric constant of the energy radiation curable resin, silicone resins, fluorinated acrylate, silicone acrylate, etc. may be selected without any particular limitation. The energy radiation curable resin preferably has an elongation of at least 30%, more preferably at least 100%. Additives commonly used in resins of the type under consideration for forming coatings on insulated electric wires, such as foaming agents, antioxidants, photostabilizers, resin coupling agents, surface treating agents and particle dispersants may be incorporated and this is effective for attaining various purposes such as reducing capacitance, stabilizing coating resins, and enhancing mechanical characteristics and functional capabilities.

In the coating resin composition which is obtained by mixing heat expansible microspheres with an energy radiation curable resin, the ratio of the amount of heat expansible microspheres to that of the energy radiation curable resin should be at least 5 vol % in order to insure that the coating formed by the expansion of the microspheres and the curing of the energy radiation curable resin has a porosity of at least 40%, and should not exceed 50 vol % in order to insure that the coating resin composition can be applied continuously, namely, to use it as a continuously applicable viscous fluid. A suitable ratio of the microspheres to the curable resin may be selected from this range in order to achieve a desired porosity.

For practical purposes, the coating resin composition obtained by mixing the heat expansible microspheres and the energy radiation curable resin preferably has a viscosity in the range of from 100 to 100,000 cPs. In order to realize easy coating operations, it is particularly desirable to adjust the viscosity to lie within the range of 1,000-10,000 cPs. Among various energy radiation curable resins, ultraviolet curable resins which provide for great freedom in the choice of viscosity are suitable for the purpose of obtaining coating resin compositions of 1,000-10,000 cPs.

The coating thickness is in no way limited but in order to insure satisfactory curing of the energy radiation curable resin, a thickness of no more than 500 μm is preferred.

The conductor that can be used is not limited in any particular way and known electric conductors such as copper, aluminum, alloys thereof, etc. which may be plated on their surface may be used.

Figure 1:
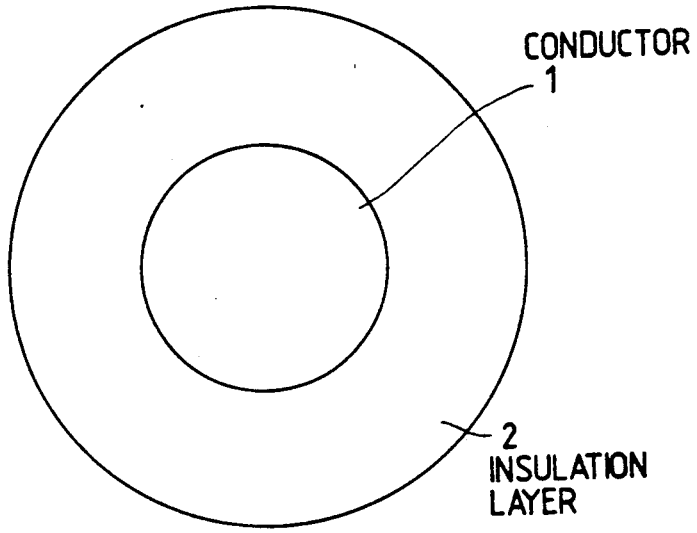
FIG. 1 is a cross section showing an example of the insulated electric wire produced by the process of the present invention.

FIG. 1 is a cross section of an example of the insulated electric wire of the present invention. Shown by numeral reference 1 is a conductor and 2 is an insulation layer that is formed around the conductor by coating and heating an energy radiation curable resin that has heat expansible microspheres incorporated therein. If desired, a solid layer made of an energy radiation curable resin may be provided on the insulation layer 2 for the purpose of improving its mechanical strength. Alternatively, a coaxial cable can be constructed by surrounding the insulation layer 2 with outer conductors and an outer insulation layer, the outer conductors being braids, pipes and other forms of an electric conductor such as copper or aluminum.

The process for producing the insulated electric wire of the present invention is described hereinafter with reference to accompanying drawings. In the present invention, the foamed insulation layer may be formed by a technique commonly employed in the art, i.e., incorporating heat expansible microspheres in a coating resin, applying the resulting resin composition over the conductor, and curing the applied coating which is either preceded or followed by expansion of the microspheres.

Figure 2:
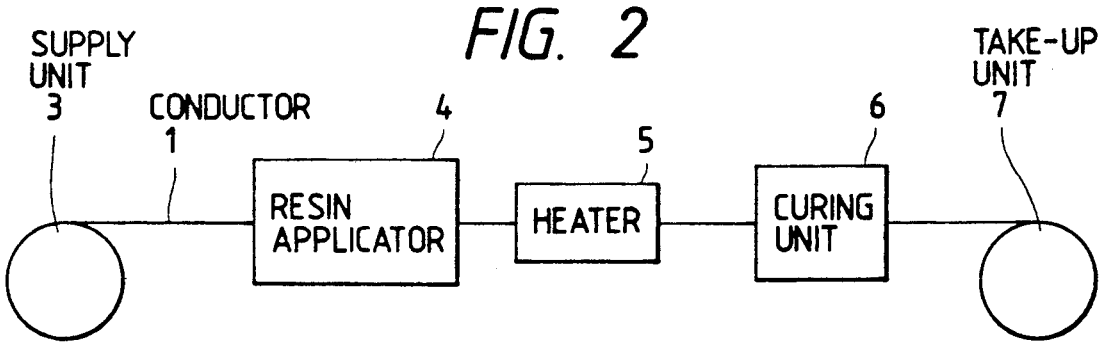
FIGS. 2 and 3 show diagrammatically two examples of the process for producing an insulated electric wire by the present invention.

FIG. 2 shows diagrammatically the process of producing an insulated electric wire according to an embodiment of the present invention. A conductor 1 delivered from a supply unit 3 is fed into a resin applicator 4, in which a coating resin composition having heat expansible microspheres 2 incorporated in an ultraviolet or electron curable resin is coated around the conductor 1. The applied coating resin composition is heated in a heater 5, where the microspheres in the resin composition are expanded. The conductor with the resin composition formed around it is thereafter supplied to a resin curing unit 6 where the resin composition is cured by exposure to an energy radiation such as ultraviolet rays or electron beams, to thereby form a resin coating 2 around the conductor 1. The resin applicator 4 is such an apparatus that a coating resin composition having fairly high viscosity that has heat expansible microspheres confined therein can be applied uniformly, and this may be accomplished by a known technique such as application with a pressure die or dipping with an open die. Reference numeral 7 indicates a take-up unit for taking up the coated conductor 1.

Figure 3:
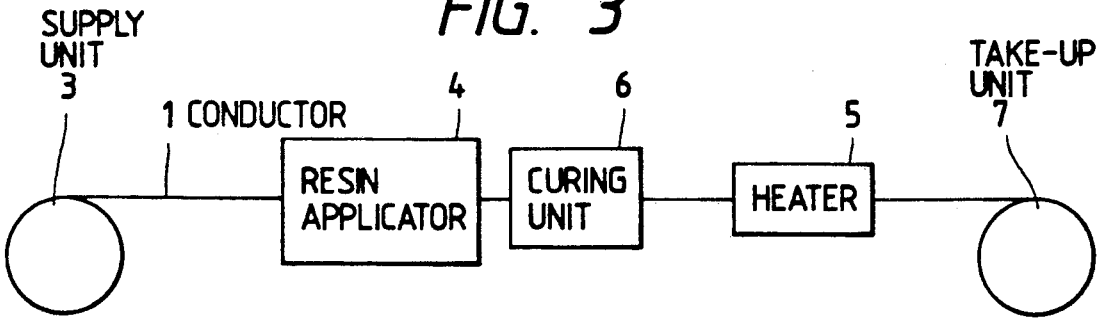
Figure 4:
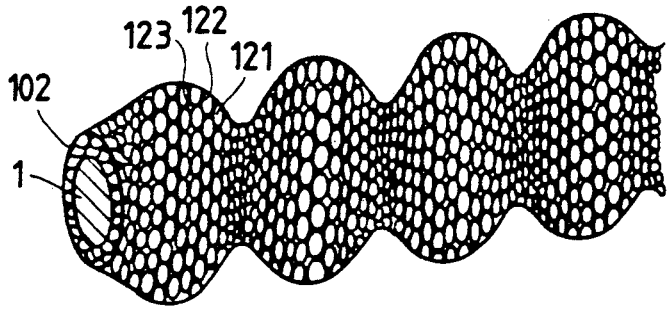
FIG. 4 shows an example of forming a thick-walled portion in the circumferential direction of a conductor in such a way that it is repeated cyclically along the conductor length.

FIG. 3 shows diagrammatically another embodiment of the present invention. The components which are the same as those shown in FIG. 2 are identified by like numerals. In this embodiment, a coating resin composition applied is first cured in the resin curing unit 6 and thereafter heated in the heater 5 to have the heat expansible microspheres expanded and form a resin coating. The microspheres may be expanded after curing without any problem as long as a base resin is selected that withstands satisfactorily the elongation strain that will develop during the expansion of the microspheres.

As described above, the order of curing and heating the applied resin composition is not critical in the present invention. The heating temperature is within the range of 100°-200° C.

EXAMPLE 1

An insulated electric wire was produced by the process of the present invention according to the scheme shown in FIG. 2. Heat expansible microspheres (volume expansion coefficient of 40 times) made of a polyvinylidene chloride resin (average particle size, 10 μm; shell thickness, 1-2 μm) that had isobutane gas foaming agent confined therein and smaller microspheres (average particle size, 8 μm) of the same resin which also had isobutane gas confined therein were incorporated in respective amounts of 15 vol % in a silicone acrylate based ultraviolet curable resin (dielectric constant, 3.10) having a viscosity of 700 cPs, and the microspheres were dispersed by stirring to prepare a coating resin composition having a viscosity of 5,000 cPs. This resin composition was coated around a silver plated copper wire (o.d. 200 μm) in a thickness of 50 μm by means of a pressure die applicator. Then, the wire was heated at ca. 150° C. in a heater equipped with an infrared lamp. Thereafter, the applied resin composition was cured in an ir-uv irradiation unit equipped with a mercury lamp so as to produce an insulated electric wire having a coating thickness of 150 μm and an outside diameter of 500 μm. The porosity of the coating layer on the insulated electric wire as measured by the density method was found to be 90%, and its dielectric constant as measured was found to be 1.20. The cross sectional structure of the coating layer having a low dielectric constant is a structure in which the expanded microspheres are integrally bonded with each other by an ultraviolet irradiation curing method in the condition of real spheres, and voids are also formed between the microspheres.

EXAMPLE 2

An insulated electric wire was produced by the process of the present invention according to the scheme shown in FIG. 3. Heat expansible microspheres (volume expansion coefficient of 40 times) made of a polyvinylidene chloride resin that had isobutane gas foaming agent confined therein and which had an average particle size of 10 μm and a shell thickness of 1-2 μm were incorporated in an amount of 30 vol % in a silicone acrylate based ultraviolet curable resin (dielectric constant, 3.10) having a viscosity of 700 cPs, and the microspheres were dispersed by stirring to prepare a coating resin composition having a viscosity of 5,000 cPs. As in Example 1, this resin composition was coated around a silver plated copper wire (o.d. 200 μm) in a thickness of 50 μm by means of a pressure die applicator. Then, the applied resin composition was exposed to ultraviolet radiation in an ultraviolet irradiation unit equipped with a heat-of-radiation blocking mercury lamp, to thereby cure the resin composition to form a coating. The conductor with a resin coating was thereafter heated at ca. 150° C. in a heater equipped with an infrared lamp, to thereby produce an insulated electric wire having a coating thickness of 150 μm and an outside diameter of 500 μm. The porosity of the coating layer on the insulated electric wire as measured by the density method was found to be 86%, and its dielectric constant as measured was found to be 1.24. It was observed that the cross sectional structure of the coating layer having a low dielectric constant consists of the expanded microspheres which come into close contact with each other in the form of a honeycomb. It was also found that the surface of the coating layer has the helical uneven formed in the longitudinal direction of the coated insulated electric wire.

COMPARATIVE EXAMPLE 1

The procedure of Example 2 was repeated except that the heater equipped with an infrared lamp was not used. The resulting insulated electric wire had a coating thickness of 80 μm and an outside diameter of 360 μm. The porosity of the insulation layer on the wire as measured by the density method was found to be 35%, and its dielectric constant as measured was found to be 2.20. Obviously, the insulated electric wire produced in Comparative Example 1 had undesirably high dielectric constant. The surface of the coating layer was also found to be smooth.

FIGS. 4 to 7 are perspective views showing the shape of the inner insulation layer in the insulated electric wire of the present invention, as well as specific examples of the formation of an outer insulation layer or outer conductors. In the example shown in FIG. 4, a conductor 101 is surrounded by an inner insulation layer 102 that is made of an energy radiation curable resin composition containing heat expansible microspheres and that has a thick-walled portion (projection) and a recess formed alternately in the circumferential direction of the conductor 101. Shown by 121 is an expanded foam, 122 is the shell of a microsphere, and 123 is an energy radiation curable resin.

Figure 5:
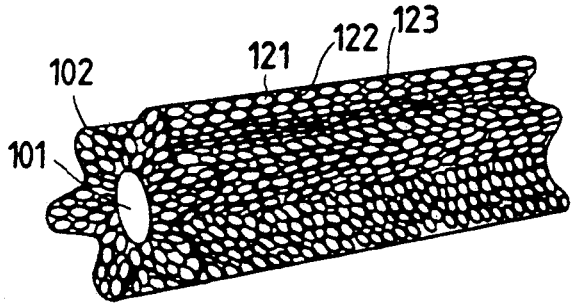
FIG. 5 shows an example of forming a thick-walled portion that extends in the longitudinal direction of the conductor.

FIG. 5 shows an example in which the conductor 101 is surrounded by an inner insulation layer 102 having a thick-walled portion and a recess formed alternately in the longitudinal direction of the conductor 101.

Figure 6A:
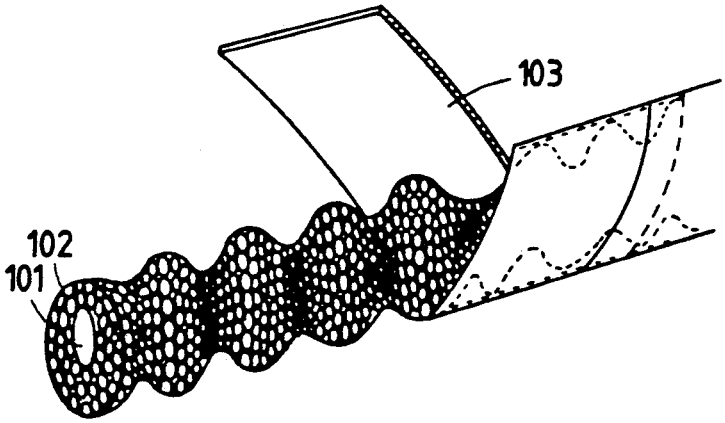
FIG. 6(*a*) shows a method of forming an outer insulation layer by winding a tape over an inner insulation layer having a thick-walled portion formed helically, namely, in both longitudinal and cicumferential directions of the conductor.
Figure 6B:
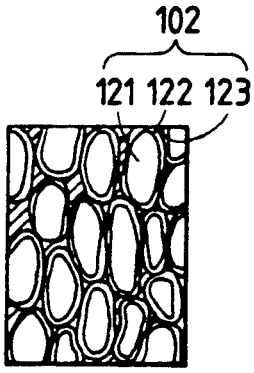

FIG. 6(*a*) shows an example in which the conductor 101 is surrounded by an inner insulation layer 102 having a thick-walled portion formed helically (i.e. in both circumferential and longitudinal directions of the conductor 101), with a tape being wound over the inner insulation layer to form an outer insulation layer 103. FIG. 6(*b*) is an enlarged view of a cross section of the inner insulation layer.

Figure 7:
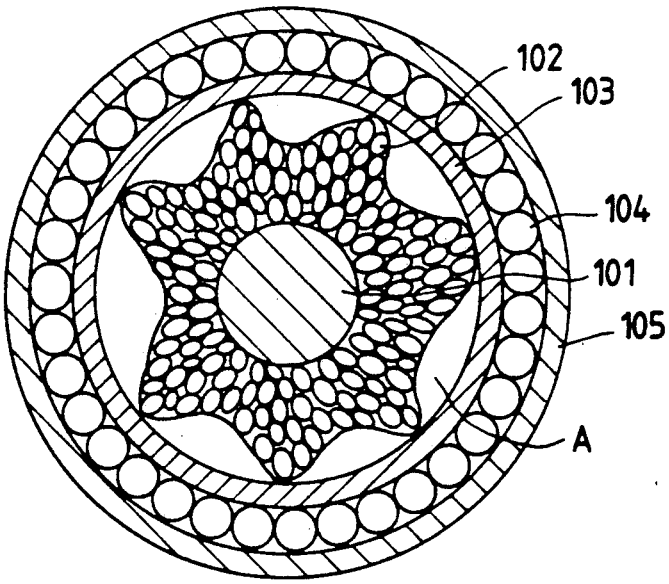
FIG. 7 is a cross section of the coaxial electric wire of the present invention.

FIG. 7 shows a coaxial electric wire in which the outer insulation layer 103 is surrounded by outer conductors 104 in cylindrical form which in turn is surrounded by a jacket 105. Shown by A in FIG. 7 is the void in the coaxial wire.

In order to form a coating that has a helical arrangement of thick-walled portion, it is particularly effective to use a coating resin composition in which heat expansible microspheres having a volume expansion coefficient of at least 10 are added in an amount of at least 20 vol % of the energy radiation curable resin.

The cylindrical outer insulation layer can be formed by various methods in the present invention, such as by laterally winding a tape made of polyimide, polyethylene terephthalate, fluorine resin, polyethylene, etc., or by melt-extruding polyethylene, fluorine resin, etc. in pipe form. for the purpose of forming an insulation layer as thin as 3-5 μm, the former method is preferred.

The inner conductor that can be used in the present invention is not limited in any particular way and known electric conductors such as copper, aluminum, alloys thereof, etc. which may be plated on their surface may be used. The outer conductors can also be made of similar materials which are in the form of a laterally wound tape or braids of fine filaments.

Figure 8:
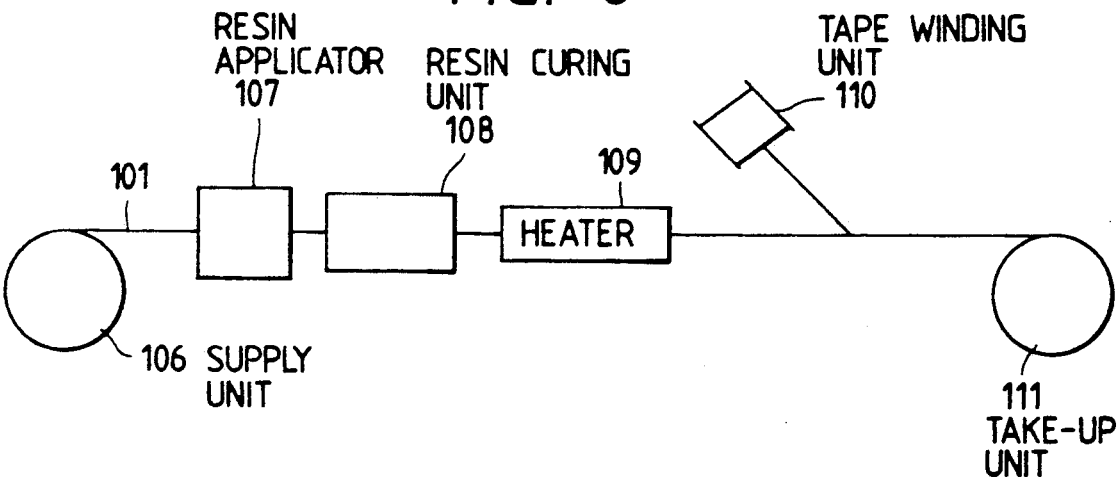
FIG. 8 is a flowsheet showing an example of the process for producing an insulated electric wire according to the present invention.

The process for producing the insulated electric wire of the present invention is described below with the embodiment shown in FIG. 8 taken as an example. A conductor 101 delivered from a supply unit 106 enters a resin applicator 107, in which a coating resin composition having heat expansible microspheres incorporated in an energy radiation curable resin is coated around the conductor 101. The applied coating resin composition is cured in a resin curing unit 108 by exposure to an energy radiation such as heat, ultraviolet rays or electron beams and a resin coating 102 is formed over the conductor 101. The resin applicator 107 is such an apparatus that a coating resin composition having fairly high viscosity that has microspheres confined therein can be applied uniformly, an this may be accomplished by a known technique such as application with a pressure die or dipping with an open die.

The conductor having the coating of resin composition formed around it is heated in a heater 109 at 50°-200° C., whereupon the microspheres are expanded and the coating layer increases in volume about 10-40 times as great as the initial value before heating, to thereby form a foamed insulation layer having a thick-walled portion in the longitudinal direction and/or circumferential direction of the conductor. The conductor then enters a tape winding unit 110 where a tape or polyethylene terephthalate or the like is laterally wound in contact with the thick-walled portion of the foamed insulation layer to form an outer insulation layer. The so produced insulated electric wire is wound up by means of a take-up unit 111.

In the insulated electric wire of the present invention, the cylindrical outer insulation layer is held integral with the inner central conductor by means of the inner insulation layer having a helical or otherwise formed thick-walled portion, and there is a large void present between the inner and outer insulation layers. In addition, the inner insulation layer itself has a high porosity resulting from the expansion of the microspheres incorporated in that layer. Hence, taken as a whole, the insulated electric wire of the present invention has a porosity of 80-95% which is nearly equal to the ultimate value for thin-walled insulated wires. Consequently, the inner insulation layer can be designed to have a low apparent dielectric constant which is no greater than 1.40.

EXAMPLE 3

Heat expansible microspheres of a vinylidene chloride polymer (average volume expansion coefficient, 40) that contained an isobutane gas releasing foaming agent and that had an average particle size of 10-20 μm and a shell thickness of 2-4 μm were added in an amount of 25 vol % to an ultraviolet curable silicone resin (dielectric constant after curing, 2.90) having a viscosity of 700 cPs, and the microspheres were dispersed by stirring to prepare a coating resin composition having a viscosity of 5,000 cPs. This resin composition was applied over a silver plated copper wire (o.d. 150 μm) in a thickness of 25 μm and given an energy radiation in a metal halide uv-ir furnace (200° C.) in the furnace to expand the microspheres simultaneously with the curing of the resin, to thereby produce an electric wire having a maximum outside diameter of 290 μm that was provided with a resin coating having a helically formed thick-walled portion. A PET tape 4 μm thick was wound in-line over the wire to produce an insulated electric wire having an outside diameter of ca. 310 μm that contained both an inner and an outer insulation layer. The apparent dielectric constant of the inner insulation layer as measured was found to be 1.29 and its apparent porosity was 80%

EXAMPLE 4

Heat expansible microspheres of a vinylidene chloride polymer (average volume expansion coefficient, 40) that contained an isobutane gas releasing foaming agent and that had a particle size of 1-10 μm and a shell thickness of 2-4 μm were added in an amount of 35 vol % to a fluorinated acrylate based ultraviolet curable resin (dielectric constant after curing, 3.10) having a viscosity of 100 cPs, and the microspheres were dispersed by stirring to prepare a coating resin composition having a viscosity of 2,000 cPs. This resin composition was applied over a silver plated copper wire (o.d. 130 μm) in a thickness of 35 μm and the uv curable resin in that resin composition was cured by passage through an uv furnace composed of an ir cutting quartz pipe, an ir transmitting mirror and a mercury lamp. Thereafter, the conductor was passed through an ir furnace at 200° C. to expand the microspheres, thereby producing an electric wire having a maximum outside diameter of 290 μm that was provided with a resin coating having a helically formed thick-walled portion. A PET tape 4 μm thick was wound in-line over the wire to produce an insulated electric wire having an outside diameter of ca. 310 μm that had both an inner and an outer insulation layer. Tin-plated copper wires (30 μm$^{\Phi}$) were stranded around this insulated electric wire and a PET tape 4 μm thick was wound over the outer conductor layer to form a jacket, thereby producing a coaxial insulated electric wire having an outside diameter of ca. 390 μm. The capacitance (C) of this coaxial wire was as low as 76 pF/m. The apparent dielectric constant of the inner insulation layer as measured was found to be 1.13 and its apparent porosity was 92%.

Figure 9:
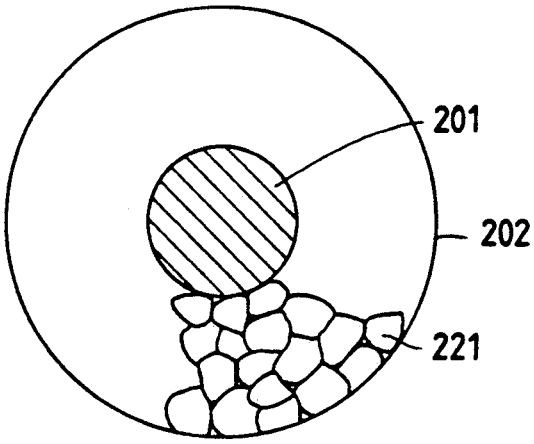
FIG. 9 is a cross section of an example of the insulated electric wire of the present invention.

FIG. 9 is a cross section of an example of the insulated electric wire of the present invention. Shown by numeral reference 201 is a conductor and 202 is an insulation layer that is formed around the conductor by coating an energy radiation curable resin having microspheres incorporated therein. The pores 221 formed by the microspheres provide a "honeycomb" structure in the example shown and this helps attain a maximum porosity.

Figure 10:
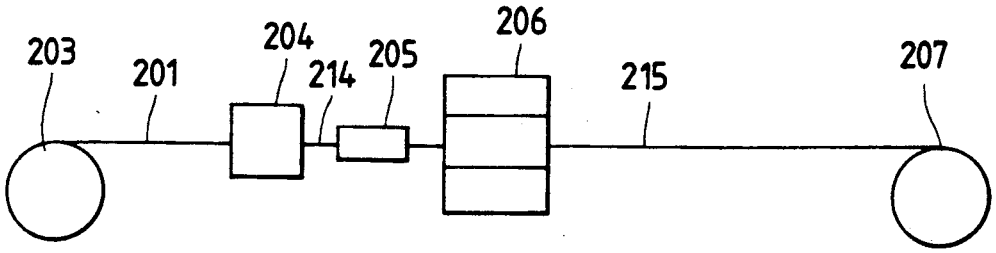
FIG. 10 shows diagrammatically an embodiment of the present invention.

The process for producing the insulated electric wire of the present invention which is shown in FIG. 9 is described below with the embodiment shown in FIG. 10 being taken as an example. A conductor 201 delivered from a supply unit 203 enters an applicator 204, in which a coating resin composition having heat expansible microspheres 223 incorporated in an energy radiation curable resin 222 is coated around the conductor 201 to form a coated layer 224. The wire 214 consisting of the coated layer 224 and the conductor 201 is supplied in-line into a heater 205, where it is heated and the heat expansible microspheres 223 in the coated layer 224 are expanded to increase the outside diameter of said layer. While the microspheres 223 are still being expanded, the wire 214 is directed into a molding/curing unit 206 in the next stage, where the outside diameter of the coated layer 224 expanding in volume is controlled by the molding section of the unit 206 while at the same time, the resin 222 is cured by exposure to an energy radiation to produce an insulated electric wire 215 having an insulation coating layer formed thereon. The insulated wire is then wound up by a take-up unit 207.

The resin applicator 204 is preferably such an apparatus that a coating resin composition having fairly high viscosity that has microspheres confined therein can be applied uniformly, and this may be accomplished by a known technique such as application with a pressure die or dipping with an open die.

The molding and curing unit 206 is preferably of a type that comprises molding means such as a sizing jig made of a material transmissive of an energy radiation such as ultraviolet rays and irradiation means that is provided around said molding means and which includes a source of ultraviolet radiation such as a mercury lamp, a light condensing and reflecting plate, etc. For example, a cylindrical molding die made of quartz glass that is installed in the neighborhood of the light condensing section of an ultraviolet applying unit may be used.

The present invention provides a process and apparatus for producing a honeycomb structure of pores and a porosity of at least 90% can be provided with such a honeycomb structure of pores.

The reasons why high porosities that have been unattainable by the prior art in insulation layers thinner than 500 μm can be realized by the process of the present invention are described below in greater detail with reference to FIG. 11 which shows a specific example of coating, molding and curing operations to be performed in the present invention.

Figure 11:
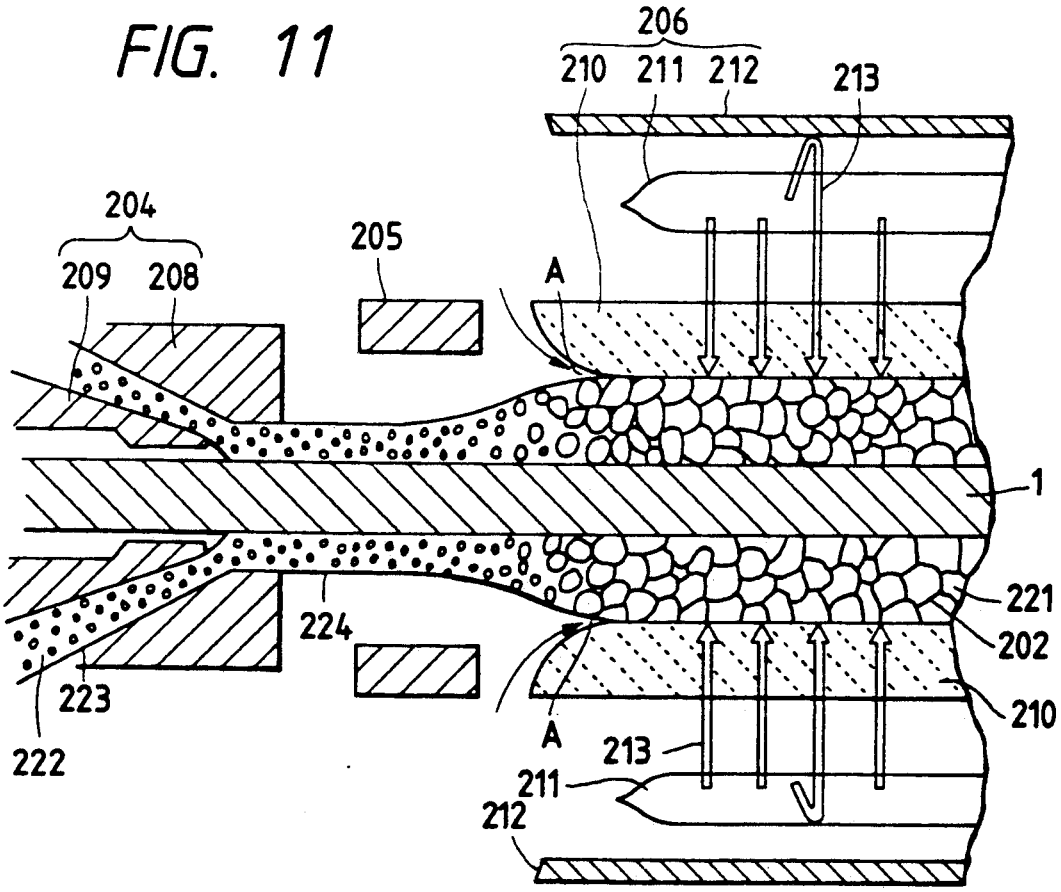
FIG. 11 is a partial enlarged sectional view of FIG. 10.

In FIG. 11, part of the die which is one component of the applicator 204 and part of the pointer which the other component of said applicator are indicated by 208 and 209, respectively. Shown by numeral reference 205 is a heater and 206 refers to part of a molding/curling unit. A coated layer 224 formed over the conductor 201 as it passes through the die 208 and pointer 209 in the applicator 204 is composed of a resin composition 222 chiefly composed of an ultraviolet radiation curable resin having heat expansible microspheres incorporated therein. As it passes through the heater 205, the coated layer 224 is heated at 50°-200° C. and the microspheres 223 in the layer 224 are expanded to increase its outside diameter while it is directed into the molding/curing unit 206 where both shaping and exposure to an energy radiation (in the case under consideration, ultraviolet rays) are to be performed. The outside diameter of the coated layer 224 is restricted by the molding means 210 which is a quartz sizing jig, so in order to provide a maximum volume for voids (pores), a foamed coating layer having a "honeycomb" cross section is formed and at the same time, the ultraviolet curable resin undergoes a curing reaction by exposure to the energy of ultraviolet radiation emitted from an uv-ir lamp 211, to thereby form a foamed insulation coating layer 202 having the cross-sectional structure shown in FIG. 11. Shown by numeral reference 212 is a reflecting mirror, and 213 is the emitted uv-ir radiation.

EXAMPLE 5

Thermally heat expansible microspheres (Expancel DU$^T$ of Kema Nobel, Inc.) that had an isobutane gas releasing foaming agent confined in the shell of a vinylidene chloride-acrylonitrile copolymer (average particle size, 10 μm; shell thickness, 1-2 μm) were added to and dispersed in an amount of 30 vol % in an ultraviolet curable silicone resin (dielectric constant after curing, 2.9; breaking extension, 130 %) having a viscosity of 1,000 cPs, to thereby prepare a coating resin composition having a viscosity of 10,000 cPs. This resin composition was applied over an electric wire and the coating was cured and molded as accompanied by sizing in accordance with the production line shown in FIGS. 10 and 11.

The resin composition was coated around a silver plated copper wire (o.d. 150 μm) in a thickness of 35 μm by means of a pressure coating die 204. The wire was then passed through a heating furnace 205 at 150° C. to expand and activate the microspheres in the coated layer. The wire was passed in-line through a pure quartz sizing die 210 that was integral with an uv-ir lamp 211 in such a way that the cavity in the die could be irradiated with uv-ir rays 213. The microspheres in the coated layer were further expanded thermally within the sizing die 210 and at the same time, the coated layer was forcefully shaped and allowed to cure to produce an insulated electric wire having an outside diameter of 450 μmϕ (coating thickness, 150 μm) as shown in cross section in FIG. 10. The pores in the insulation layer had been expanded to 30-40 μm.

In the operation described above, the coated conductor was allowed to pass smoothly through the sizing die by continuously supplying a lube oil (silicone oil) onto the inner surface of the die from portion A in FIG. 11.

The coating on the insulated electric wire produced in this example was found to have a porosity of 95% as measured by the density method and its dielectric constant was 1.10. The surface of the coating surface was smooth, and the contents thereof was of a complete honeycomb structure.

Figure 12:
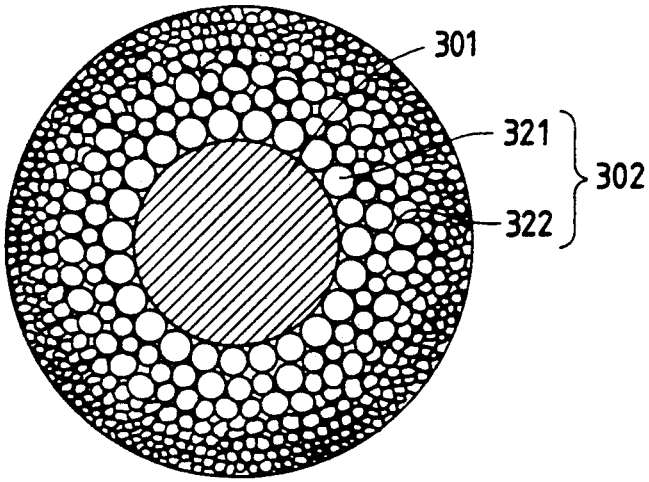
FIG. 12 is a cross-section showing an example of the insulated electric wire of the present invention.

FIG. 12 is a cross section of an example of the insulated electric wire of the present invention. Shown by numeral reference 301 is a conductor and 302 is an insulation layer that is formed around the conductor by coating an energy radiation curable resin 322 having microspheres 321 incorporated therein. As shown, the outside diameter of the microspheres 321 in the insulation layer 302 increases toward the conductor 301 and decreases gradually toward the periphery of the insulation layer 302.

The process for producing the insulated electric wire of the present invention in which the outside diameter of microspheres in the insulation coating layer has such a distribution that it increases toward the conductor is described below with the embodiment shown in FIG. 13 being taken as an example. A conductor 301 delivered from a supply unit 303 is heated preliminarily in a heater 306. The conductor then enters a resin applicator 304, in which a coating resin composition having microspheres 302 incorporated in an energy radiation curable resin is coated around the conductor 301. The temperature for preliminary heating is preferably within the range of from about 100° to 300° C. The applied coating resin composition is cured in a resin curing unit 305 by exposure to an energy radiation such as heat, ultraviolet rays or electron beams and a resin coating 302 is formed over the conductor 301. Since the conductor 301 is preliminarily heated, the microspheres that are closer to the conductor are expanded by a greater degree than those remote from the conductor. Reference numeral 307 indicates a take-up unit for taking up the coated conductor 301.

As shown in FIG. 12, the outside diameter of microspheres in the insulation coating layer increases toward the conductor, so the insulated electric wire of the present invention has the advantage that dielectric constant in the vicinity of the conductor is sufficiently low to insure satisfactory insulation.

In the present invention, the conductor is preliminarily heated at a temperature of about 100°-300° C. before it is coated with a resin composition having microspheres incorporated therein. Hence, the liquid, foaming agent or gas confined in microspheres that are situated in contact with the hot conductor will expand significantly but microspheres on the periphery of the coating layer will not be influenced by the temperature of the conductor and their contents will hardly expand. The conductor having the resin coating in this state enters the resin curing unit in the next stage, in which the microspheres on the periphery of the coating layer will be somewhat expanded if heat is used as curing energy but taken as a whole, the resin coating is cured to provide an insulation layer in which the outside diameter of microspheres gradually decreases outward.

If the base resin is exposed to high heat for curing purposes, the gas in resin-made microspheres can expand or contract or the microspheres might themselves deform to make it impossible to maintain the desired porosity. If, on the other hand, an ultraviolet curable resin is used as an energy radiation curable resin in the present invention, no heat is applied in the curing step and a favorable condition is provided for the purpose of creating the intended distribution of the outside diameter of microspheres. Further, it becomes possible to use microspheres made from a low-dielectric constant resin and an insulation coating having a very low dielectric constant can be attained by selecting an energy radiation curable resin that has a low intrinsic dielectric constant.

The expanded microspheres have a uniform diameter of about 1-100 μm and a shell thickness not greater than 0.5 μm. Hence, the formation of pores is insured even if the coating applied is very thin and it becomes possible to manufacture an insulated electric wire capable of high-speed transmission that has a capacitance of 1.60 or below even if the insulation layer has such a small thickness of 200 μm or below that has not been attainable by the prior art.

In the present invention, an energy radiation curable resin composition that has microspheres incorporated therein is applied over a conductor and subsequently cured by exposure to an energy radiation such as heat, ultraviolet rays or electron beams. This process enables insulated electric wires to be manufactured at a significantly higher speed than in the prior art which involves foaming of a thermoplastic resin or winding of a tape over the conductor.

As described above, the insulation layer is formed by coating a resin composition whose dielectric constant is predetermined by properly selecting the content of microspheres in the resin composition and its constituent material, and this is effective in avoiding possible variations in capacitance that may be caused by instability in the manufacturing process. Consequently, insulated electric wires of consistent quality can be easily produced by the present invention.

Further, the fine microspheres in the resin layer which have a particle size distribution of 1-100 μm are the greater in diameter as they are situated the closer to the conductor and the relative amount of the base resin increases toward the periphery of the resin layer. This contributes to the formation of a smooth-surfaced insulation layer and hence an improvement in the mechanical strength of the insulation coating.

EXAMPLE 6

Heat expansible microspheres (volume extension coefficient of 40 times) that had an isobutane gas releasing agent confined therein, that had an average particle size of 5-10 μm and that had a vinylidene chloride polymer shell with a thickness of 1-2 μm were incorporated in an amount of 20 vol % in a silicone acrylate based ultraviolet curable resin (dielectric constant after curing, 2.95) having a viscosity of 700 cPs, and the microspheres were dispersed by stirring to prepare a coating resin composition having a viscosity of 5,000 cPs.

Figure 13:
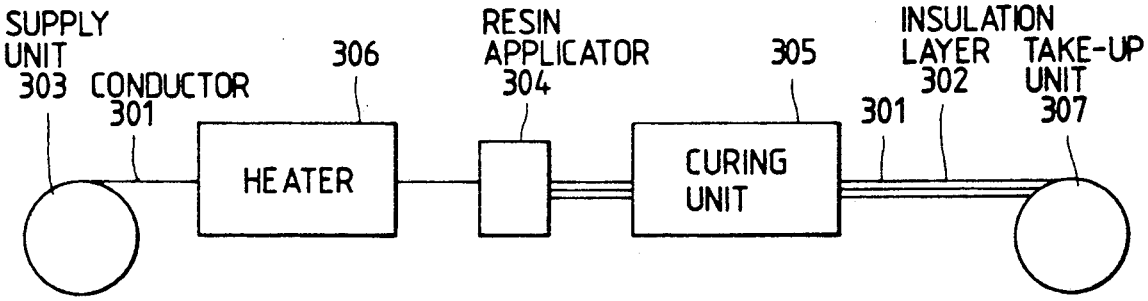
FIG. 13 shows diagrammatically an example of the process for producing an insulated electric wire according the present invention.

According to the production line shown in FIG. 13, a silver plated copper wire (o.d. 150 μmϕ) was preliminarily heated in an infrared furnace at 200° C. Thereafter, the coating resin composition was coated around the preheated copper wire in a thickness of 40 μm by means of a pressure die. The copper wire was then passed through an uv-ir irradiation unit equipped with a mercury lamp so that the microspheres were expanded simultaneously with the curing of the uv curable resin to produce an insulated electric wire having an outside diameter of 400 μmϕ.

Examination of a cross section of the coating in the insulated electric wire showed that the microspheres in it were expanded by a greater degree as they were situated the closer to the preheated conductor: the outside diameter of the microspheres was 40-50 μmϕ in the area the closest to the central conductor, 20-30 μmϕ in the middle portion of the cross section of the coating, and 10-20 μmϕ in the outermost portion of the coating. The insulation coating of the wire had a porosity of 70% as measured by the density method, and its dielectric constant was as low as 1.46. The surface of the coating layer was smooth.

As described above, the present invention provides a process by which an insulated electric wire that has a small diameter (thin insulation coating) and which yet has a low capacitance can be produced at a faster speed than in the prior art with the coating surface kept smooth and in a consistent way without deviations or variations from a design value of capacitance even in the presence of disturbances from the manufacturing process. The insulated electric wire produced by the present invention has an insulation coating thickness of no greater than 200 μm and a dielectric constant of 1.60 or below, which values have been unattainable in the prior art.

Also, the present invention provides an insulated electric wire or a coaxial electric wire that have both an inner and an outer insulation layer. The inner insulation layer is a coating having high porosity that is formed of heat expansible microspheres and an energy radiation curable resin. Further, the inner insulation layer has a thick-walled portion that extends cyclically in either helical or rib form along the conductor length. Because of these features, the inner insulation layer has an apparent porosity of 80–95% which is nearly equal to the ultimate value for thin-walled insulated electric wires. Hence, the inner insulation layer can be designed to have a dielectric constant as low as 1.20–1.30.

Further, a coated layer of an energy radiation curable resin containing microspheres that has been formed on the surface of a conductor is subjected to sizing while hot and, at the same time, the layer is cured by exposure to an energy radiation. As a result, a coating of a honeycomb structure having a porosity of at least 90% which is nearly equal to the ultimate value can be formed as a smooth-surfaced layer.

While energy radiation curable resins generally have a fast curing rate, ultraviolet curables resin cure at a particularly fast rate, so if they are used in the present invention, the coating layer described above can be formed at high speed and in a very small thickness.

The process described above for producing an insulated electric wire can be implemented in an efficient way by the apparatus also described herein.

As described the above, the insulated electric wire of the present invention contains microspheres in the insulation layer, which are expanded by heat in such a way that a higher porosity is provided in an area that is the closer to the conductor and this contributes a reduction in the overall dielectric constant of the insulation layer. On the other hand, the microspheres present in an area which is the closer to the periphery of the insulation coating are expanded by a smaller degree. Hence, the insulation coating is formed as a layer that has an overall high porosity but which is smooth on the outer surface on account of the high content of the base resin, and this contributes to an improvement in the mechanical strength of the coating.

The process of the present invention offers the advantage of providing an insulation coating in which the outside diameter of microspheres has the distribution described above.

Hence, the present invention finds great utility in the production of low-dielectric constant, thin-walled insulated electric wires that are suitable for use as ultrathin wires in the medical field and other applications such as measuring apparatus and computers where fine, high-speed transmission lines are in a most rapidly increasing demand.

What is claimed is:

1. A process for producing an insulated electric wire, comprising the steps of:

preliminarily heating a conductor;

coating around said preliminary heated conductor with an ultraviolet radiation curable resin composition having heat expansible microspheres incorporated therein; and curing said ultraviolet radiation curable resin composition by exposure to ultraviolet radiation;

wherein as a result of said preliminary heating step an outside diameter of said heat expansible microspheres in said ultraviolet radiation curable resin composition is maximum in vicinity of said conductor and decreases gradually toward periphery of said ultraviolet radiation curable resin composition layer coated on said conductor.

2. A process for producing an insulated electric wire, comprising the steps of:

applying over a conductor an ultraviolet radiation curable resin composition having heat expansible microspheres incorporated therein to form a resin composition layer coated on said conductor;

heating said resin composition layer; and subsequently curing said resin composition layer with an ultraviolet radiation being applied thereto and with an outside diameter of said resin composition layer being controlled by a molding unit installed in an area including a space where said resin composition layer is foaming and/or expanding in a radial direction thereof to form an insulation coating layer on said conductor.

* * * * *